US006473053B1

(12) United States Patent
Krishmar-Junker et al.

(10) Patent No.: US 6,473,053 B1
(45) Date of Patent: Oct. 29, 2002

(54) DUAL FREQUENCY SINGLE POLARIZATION FEED NETWORK

(75) Inventors: Gregory P. Krishmar-Junker, Redondo Beach, CA (US); Charles W. Chandler, San Gabriel, CA (US); Makkalon Em, Venice, CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/860,105

(22) Filed: May 17, 2001

(51) Int. Cl.[7] ..... H01Q 13/00
(52) U.S. Cl. ..... 343/772; 343/756; 343/786
(58) Field of Search ..... 343/771, 772, 343/776, 756, 786, DIG. 2

(56) References Cited

U.S. PATENT DOCUMENTS 3,731,235 A * 5/1973 Ditullio et al. ..... 333/135
4,228,410 A * 10/1980 Goudey et al. ..... 333/122
4,847,574 A * 7/1989 Gauthier et al. ..... 33/21 A
5,280,297 A * 1/1994 Profera, Jr. ..... 343/754
5,635,944 A * 6/1997 Weinstein et al. ..... 343/776
6,094,175 A * 7/2000 Alessi et al. ..... 343/786
6,163,304 A * 12/2000 Peebles et al. ..... 343/786
6,323,819 B1 * 11/2001 Ergene ..... 343/786
6,329,957 B1 * 12/2001 Shea et al. ..... 343/756

* cited by examiner

*Primary Examiner*—Don Wong
*Assistant Examiner*—Shih-Chao Chen
(74) *Attorney, Agent, or Firm*—Harness, Dicke & Pierce, P.L.C.

(57) ABSTRACT

An antenna system that employs antenna elements for both transmit and receive functions. Signals received by each antenna element are directed to a dual band polarizer that converts the signals to linearly polarized signals, and signals to be transmitted by each antenna element are converted to circularly polarized signals by the polarizer. The orientation of the polarizer and whether the circularly polarized signals are LHCP or RHCP determines whether the linearly polarized signals are vertically or horizontally polarized. A dual-band orthomode transducer is employed to separate the receive and transmit signals into their respective frequency bands based on whether they are vertically or horizontally polarized. The transducer is a waveguide device having only three signal ports. A high pass filter is used to help separate the received signals, and a low pass filter is used to help separate the transmit signals.

15 Claims, 2 Drawing Sheets

DUAL FREQUENCY SINGLE POLARIZATION FEED NETWORK

BACKGROUND OF THE INVENTION

1. Field of the Invention

This invention relates generally to a dual frequency antenna system and, more particularly, to a satellite antenna system employing a dual frequency polarizer and a dual band orthomode transducer that separates a dual frequency signal having different polarizations.

2. Discussion of the Related Art

Various communications systems, such as certain telephone systems, cable television systems, internet systems, military communications systems, etc., make use of satellites orbiting the Earth to transfer signals. A satellite uplink communications signal is transmitted to the satellite from one or more ground stations, that retransmits the signal to another satellite or to the Earth as a satellite downlink communications signal to cover a desirable reception area depending on the particular use. The uplink and downlink signals are typically transmitted at different frequency bands. For example, the uplink signal may be transmitted at 30 GHz band and the downlink signal may be transmitted at 20 GHz band. The satellite is equipped with antenna systems including a number of antenna feeds that receive the uplink signals and transmit the downlink signals to the Earth.

For some of these satellite communications systems, one antenna system is provided for receiving the uplink signals and another antenna system is provided for transmitting the downlink signals. Each antenna system typically employs an array of antenna feed horns and one or more reflectors to collect and direct the signals. The uplink and downlink signals are circularly polarized so that the orientation of the reception antenna can be arbitrary relative to the incoming signal. To provide signal discrimination, one of the signals may be left hand circularly polarized (LHCP) and the other signal may be right hand circularly polarized (RHCP), where the signals rotate in opposite directions. Polarizers are employed in the antenna systems to convert the circularly polarized signals to linearly polarized signals suitable for propagation through a waveguide with low signal losses.

Because there are important weight and real estate limitations on a satellite, it is desirable to use the same antenna system for both transmitting the downlink signal and receiving the uplink signal. Because the uplink and downlink signals are at different frequency bands, the feed horns would have to be designed to transmit and receive the signals at both the uplink and downlink frequency bands. It would also be necessary to employ a dual band polarizer that could effectively convert the downlink signal from a linearly polarized signal to a circularly polarized signal and convert the uplink signal from a circularly polarized signal to a linearly polarized signal. However, known polarizers can only be optimized for a single frequency band, making them unsuitable for polarizing signals of different frequencies.

Known dual frequency antenna networks of the type being described herein sometimes employ a turnstile junction to equally divide the signal into orthogonal components. A discussion of turnstile junctions can be found in U.S. patent application Ser. No. 09/494,612, titled "Wideband TE11 mode Coaxial Turnstile Junction," and assigned to the assignee of this application.

What is needed is an antenna system and associated feed network capable of transmitting a satellite downlink signal and receiving a satellite uplink signal, that is able to effectively provide polarization conversion in two separate frequency bands. It is therefore an object of the present invention to provide such an antenna system.

SUMMARY OF THE INVENTION

In accordance with the teachings of the present invention, an antenna system is disclosed that employs antenna elements that provide both transmit and receive functions. Signals received by each antenna element are directed to a dual band polarizer that converts the signals to linearly polarized signals. Signals to be transmitted by each antenna element are converted to circularly polarized signals by the polarizer. Depending on the orientation of the dual band polarizer and whether the received signal is LHCP and/or RHCP, the polarizer will convert the circularly polarized signal to a vertically and/or horizontally linearly polarized signals. Likewise, linearly polarized signals received by the polarizer will be converted to LHCP and/or RHCP signal depending on the orientation of the polarizer with respect to the OMTand whether the linearly polarized signal is vertically or horizontally linearly polarized.

A dual-band orthomode transducer is employed to direct the transmit signals to the polarizer and receive the received signal from the polarizer. The transducer receives separate linearly horizontally polarized signals and/or linearly vertically polarized signals, and couples them together for the transmit signal. The transducer receives the receive signal and separates it into its linearly horizontally polarized components and/or linearly vertically polarized component at one and/or two ports of the transducer. In one embodiment, a high pass filter is used to help separate the receive signals, and a low pass filter is used to help separate the transmit signals.

Additional objects, advantages and features of the present invention will become apparent to those skilled in the art from the following discussion and the accompanying drawings and claims.

DETAILED DESCRIPTION OF THE PREFERRED EMBODIMENTS

The following discussion of the preferred embodiments directed to a dual band feed network for an antenna system that employs a dual band orthomode transducer is merely exemplary in nature and is in no way intended to limit the invention or its applications or uses.

Figure 1:
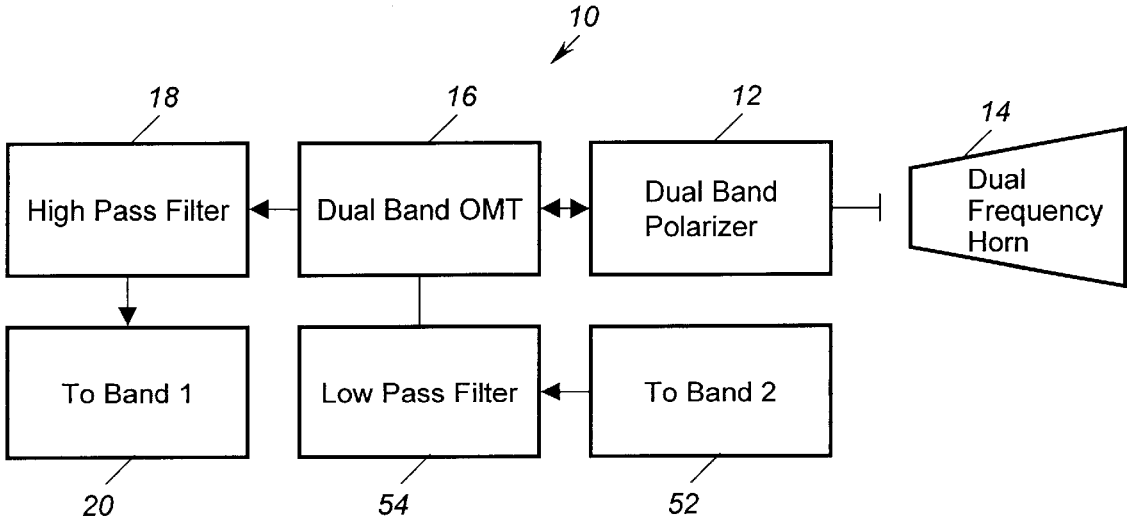
FIG. 1 is a block diagram of an antenna system employing a dual band orthomode transducer, according to an embodiment of the present invention.

FIG. 1 is a block diagram of an antenna system 10 employing a dual band feed network, according to the invention. The antenna system 10 includes a dual band feed horn 14 that receives a satellite uplink signal at a particular frequency band, for example, 28–30 GHz or 40 GHz, and transmits a downlink signal at another frequency band, for example, 18.3–20.3 GHz. Only a single feed horn is shown in the antenna system 10, with the understanding that the antenna system 10 would include an array of feed horns arranged in a desirable manner depending on the particular application. The horn 14 is shown as a square or rectangular feed horn, but is intended to represent any feed horn operable in dual frequency bands having any suitable shape, including circular or elliptical shapes. The antenna system 10 may also employ reflectors and the like for collecting and directing the uplink and downlink signals, depending on the particular application. By using the antenna system 10, separate antenna systems are not needed for the satellite uplink and downlink signals, and therefore valuable space on the satellite can be conserved and the weight of the spacecraft can be reduced.

The satellite uplink and downlink signals are circularly polarized so that the orientation of the antenna elements relative to the signal can be arbitrary. The use of RHCP and LHCP signals is important in high density applications for cell distinction, such as for cellular telephone applications. Polarizers are necessary after the feed horn 14 to convert the downlink signal from a linearly polarized signal to a circularly polarized signal, and for converting the uplink signal from a circularly polarized signal to a linearly polarized signal.

A dual band polarizer 12 performs this function for both the uplink and downlink frequency bands, either separately in time or simultaneously. Particularly, circularly polarized signals received on the satellite uplink by the dual frequency feed horn 14 are converted to a linearly polarized signal by the polarizer 12, and the linearly polarized signals to be transmitted on the satellite downlink are converted to circularly polarized signals by the polarizer 12 before being sent to the feed horn 14. The orientation of the dual band polarizer 12 relative to the signal determines whether LHCP or RHCP signals are converted to vertically or horizontally linearly polarized signals.

The uplink and downlink signals at the separate frequency bands must be separated between the polarizer 12 and the reception and transmission circuitry. In U.S. patent application Ser. No. 091860,045, titled "Dual Band Frequency Polarizer Using Corrugated Geometry Profile, a diplexer was used for this purpose. However, the diplexer is a complicated waveguide device that includes many signal ports, and is limited in its effectiveness to separate the signals. In this embodiment, a dual-band orthomode transducer (OMT) 16 is used to separate the signals into their respective frequency bands. The uplink signal includes both vertically and horizontally linearly polarized components after passing through the polarizer 12, and the downlink signal includes vertically and horizontally linearly polarized components when it enters the polarizer 12.

The OMT 16 separates the signals by whether they are vertically polarized or horizontally polarized. The OMT 16 is a waveguide device that includes waveguides ports and openings critically located to separate the vertical and horizontally polarized signals. The OMT 16 has a reduced number of waveguides over known frequency separating devices, and provides dual band separation in a more desirable manner. In this example, the uplink and downlink signals are at different frequencies. However, those skilled in the art will recognize that the OMT 16 can separate vertically and horizontally polarized signals having the same frequency.

The uplink signals are directed to a high pass filter 18 that passes the uplink frequency band, and then to receiver circuitry 20. The downlink signal generated by transmission circuitry 52 is sent to a low pass filter 54 that passes the downlink frequency band, and then to the OMT 16. The filters 18 and 24 provide increased signal isolation.

Figure 2:
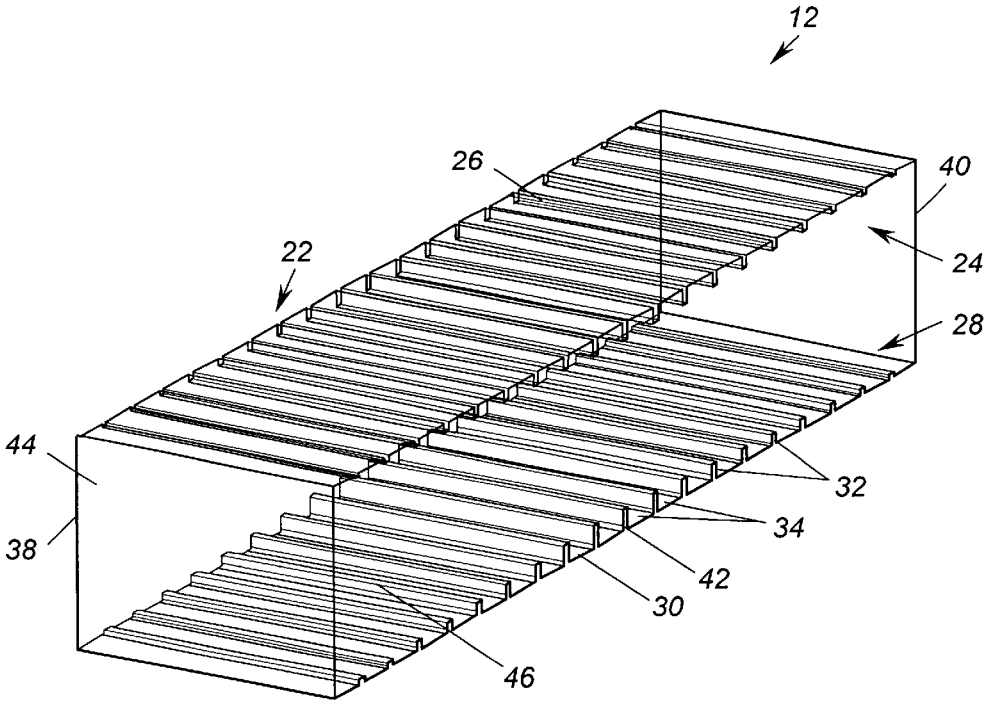
FIG. 2 is a perspective view of a dual band polarizer used in the antenna system shown in FIG. 1, according to the invention.

FIG. 2 is a perspective view of the polarizer 12. In this embodiment, the polarizer 12 is a hollow, square waveguide 22 that includes a first corrugated structure 24 extending from one sidewall 26 of the waveguide 22, and a second corrugated structure 28 extending from an opposing sidewall 30 of the waveguide 22. The corrugated structures 24 and 28 are Identical, and therefore only the corrugated structure 28 will be described herein with the understanding that the corrugated structure 24 is the same. The corrugated structure 28 includes a plurality of parallel ribs 32 defining spaces 34 therebetween. The width of the ribs 32 and the width of the spaces 34 remain constant along the length of the waveguide 22. The height of each of the ribs 32 from the wall 30 is such that the corrugated structure 28 has a tapered configuration from one end 38 of the waveguide 22 to a center of the waveguide 22, and from the center of the waveguide 22 to an opposite end 40 of the waveguide 22. Particularly, the height of the ribs 32 proximate the ends 38 and 40 are at their lowest, and the height of the ribs 32 get progressively taller in a sequential manner towards the center of the waveguide 22. In this embodiment, the center rib 42 has the largest height. This tapering of the height of the ribs 32 significantly eliminates reflections of the signal that may occur from discontinuities within the waveguide 22. The other opposing side walls 44 and 46 of the waveguide 22 are smooth. Further details of the polarizer 12 can be found in patent application Ser. No. 09/860,045.

The signals enter the waveguide 22 through both ends 38 and 40. Because the waveguide is symmetric, the circularly polarized signal from the feed horn 14 or the linearly polarized signal from the diplexer 16 can enter either end. The signal propagating through the waveguide 22 has orthogonal $E_x$ and $E_y$ field components. The E-field component that is perpendicular to the ribs 32 interacts therewith and is delayed relative to the E-field component that is parallel or transverse to the ribs 32 and does not interact with the ribs 32. In other words, the spaces 34 between the ribs 32 act as waveguides that create a phase delay between the $E_x$ and $E_y$ field components. This delay causes the signal to rotate if the input signal is linearly polarized. The length of the waveguide 22 is selected so that the E-field components end up out of phase by 90 degrees at the output end creating circular polarization. The orientation of the $E_x$, and $E_y$ field components relative to the ribs 32 determines which way the signal will rotate and whether the signal will be an RHCP or an LHCP signal. In a specific design, the E-field components of the linearly polarized downlink signal are oriented at an angle 45 degrees relative to perpendicular sides of the waveguide 22.

Alternately, the ribs 32 can speed up the E-field component that interacts with the ribs 32 to also create a phase discrepancy between the field components. When the circularly polarized signal is coming into the waveguide 22 from the opposite direction, the delay caused by the ribs 32 matches the phases of the E-field components so that by the time they reach the opposite end of the waveguide 22, they are in phase with each other making the signal linearly polarized.

The dimensions of the waveguide 22 and the dimensions and spacing of the ribs 32 are selected so that the lowest fundamental mode of the signal propagates through the waveguide 22, and the phase relationship between the E-field components are 90 degrees apart, as described above. These parameters are also dependent on the speed of the signal propagating through the waveguide 22 that is also frequency dependent. For dual band polarization conversion, these dimensions are selected so that the higher frequency band, here 30 or 40 GHz, will be polarized in the desirable manner. Then, the dimensions are optimized for the lower frequency band, here 20 GHz. In other words, the dimensions of the waveguide 22 are selected so that the components of the E-field are 90 degrees out of phase with each other for the high frequency, and then these values are slightly varied relative to each other to make the E-field components of the lower frequency band to also be 90 degrees out of phase with each other. This design criteria is possible because the lower frequency band is a subset of the higher frequency band. In the known corrugated structure polarizers, the spacing between the ribs was typically selected to be one-quarter of a wavelength of the center of the frequency band of interest. Typically only a few corrugations were necessary to perform the polarization conversion. However, in the design disclosed herein, that operates in two bands, the number of corrugations required is greater, typically on order of more than five.

In a particular design for the frequency bands discussed herein, the width of the walls 26, 30, 44 and 46 of the waveguide 22 are 0.456 inches, the thickness of the ribs 32 is 0.018 inches, the space 34 between the ribs 32 is 0.073 inches, the number of ribs 32 and the number of spaces 34 between the ribs 32 is thirty-nine and the length of the waveguide 22 is 1.802 inches. These parameters provide the desired polarization conversion for the uplink and downlink frequency bands of known satellite communication systems. For other frequency bands, these parameters will be different and optimized accordingly.

Figure 3:
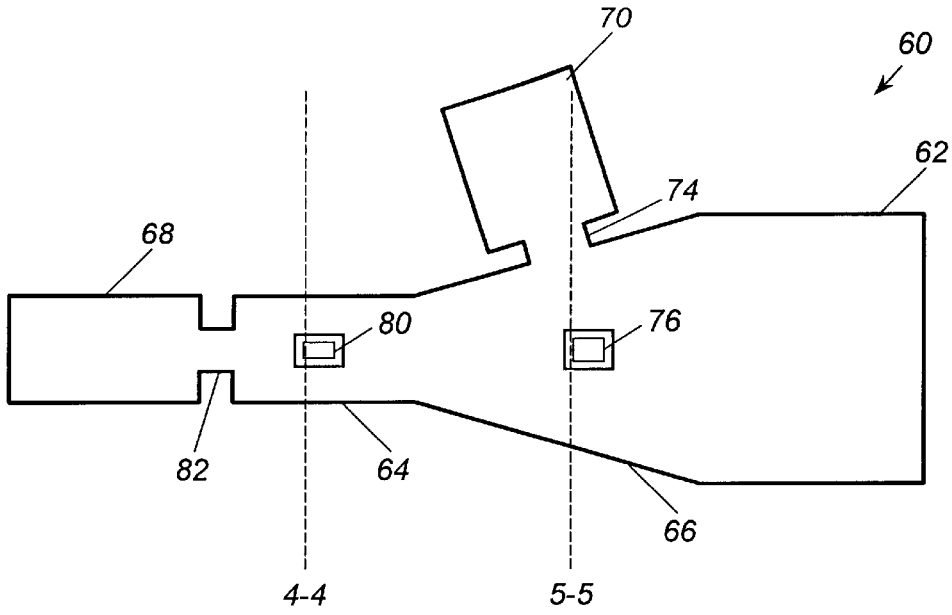
FIG. 3 is a cross-sectional view of a dual-band orthomode transducer that can be used in the antenna system shown in FIG. 1, according to one embodiment of the present invention.
Figure 4:
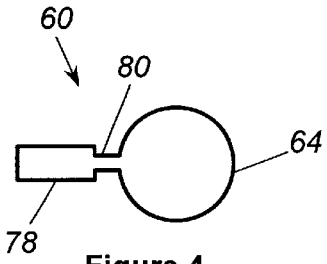
FIG. 4 is a cross-sectional view through line 4—4 of the orthomode transducer shown in FIG. 3.
Figure 5:
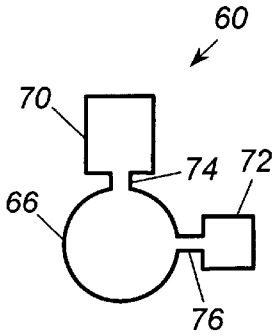
FIG. 5 is a cross-sectional view through line 5—5 of the orthomode transducer shown in FIG. 3.

FIG. 3 is a cross-sectional view of a dual-band orthomode transducer 60 that can be used as the transducer 16 discussed above. FIG. 4 is a cross-sectional view of the transducer 60 through line 4—4 and FIG. 5 is a cross-sectional view of the transducer 60 through line 5—5 in FIG. 3. The transducer 60 is a cylindrical waveguide device that includes a widened portion 62 at one end of the transducer 60 and a narrowed portion 64 at an opposite end of the transducer 60, where the portions 62 and 64 are connected together by a conical section 66. Two rectangular waveguides 70 and 72 are connected to the conical portion 66 by narrowed irises 74 and 76, respectively. Additionally, a rectangular waveguide 78 is attached to the narrowed cylindrical portion 64 by a narrowed iris 80, and a rectangular waveguide 68 is connected to the end of the waveguide 64 by a narrowed iris 82. The present embodiment may be used for either single or dual polarized feed networks. By terminating the appropriate ports in a matched load or by selection of the rectangular waveguide dimensions such that ports 76 and 80 are eliminated, the OMT in this embodiment is for single polarization. Use "as is" results in dual polarization operation.

The signals received by the feed horn 14 propagate through the dual-band polarizer 12 and enter the end portion 62 of the transducer 60. The signals from the polarizer 12 include both horizontal and vertically linearly polarized components. The orientation and configuration of the transducer 60 decouples the horizontally and vertically polarized components so that one of the horizontally or vertically polarized components propagates through the iris 82 and into the waveguide 68, and the other horizontally or vertically polarized component propagates through the iris 80 and into the waveguide 78. The separated signals are then applied to the high pass filter 18 and to the receiver circuitry 20. The irises 80 and 82 provide phase and impedance matching between the two components of the signal. In an alternate variation, the irises 80 and 82 can be stepped transformers.

Signals from the transmit circuitry 52 are separated by their horizontal and linearly polarized components, and separately enter the transducer 60 through the waveguides 70 and 72. The irises 74 and 76 provide phase and impedance matching between the waveguides 70 and 72, and the transducer 60 couples the signals together in phase to be sent to the polarizer 12 as a combined signal having both linearly and horizontally polarized components.

Figure 6:
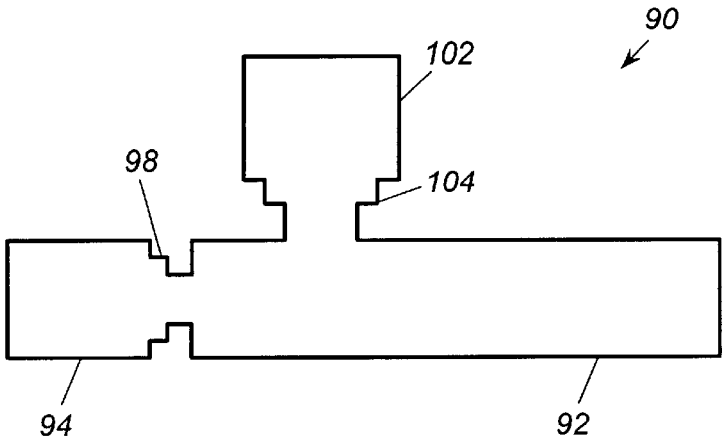
FIG. 6 is a cross-sectional view of a dual-band orthomode transducer that can be used in the antenna system shown in FIG. 1, according to another embodiment of the present invention.
Figure 7:
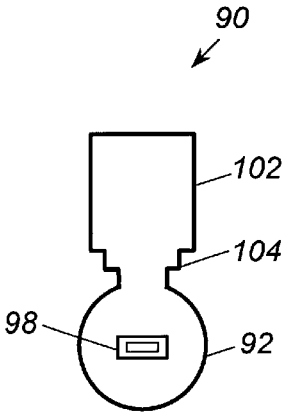
FIG. 7 is an end view of the orthomode transducer shown in FIG. 6.

FIG. 6 shows a cross-sectional view of a dual-band orthomode transducer 90 that can also be used as the dual-band transducer 16. FIG. 7 is an end view of the transducer 90. The transducer 90 includes a cylindrical waveguide 92 extending the length of the transducer 90. A rectangular waveguide 94 is connected to the circular waveguide 92 at one end of the transducer 90 by a stepped transformer 98. A rectangular waveguide 102 is connected to a sidewall of the circular waveguide 92 by a stepped transformer 104. The transformers 98 and 104 provide impedance matching for the frequency of the uplink and downlink signals.

In this embodiment, the transducer 90 is a three port device, where the waveguides 94 and 102 accommodate the uplink and/or downlink signals, respectively and/or vise versa at the different frequency bands. The uplink signals received from the polarizer 12 propagate through the waveguide 92. The horizontally and vertically polarized components of the uplink signal are separated so that one of the two components enters the waveguide 94 through the transformer 98, and the other of the components enters the waveguide 102 through the transformer 104. The downlink signals to be transmitted by the feedhorn 14 are received by the transducer 90 also through the waveguides 94 and 102. One of either the horizontally or vertically polarized components propagate through the waveguide 94, and the other of the horizontally or vertically components propagate through the waveguide 102. The waveguide 92 phase matches and couples the components together so that the horizontal and vertical components of the signal are sent to the polarizer 12.

The foregoing discussion discloses and describes merely exemplary embodiments of the present invention. One skilled in the art will readily recognize, that various changes, modifications and variations can be made therein without departing from the spirit and scope of the invention as defined in the following claims.

What is claimed is:

1. An antenna system comprising:

an antenna element, said antenna element receiving a first signal and transmitting a second signal;

a polarizing system, said polarizing system converting the first signal from a circularly polarized signal to a linearly polarized signal and converting the second signal from a linearly polarized signal to a circularly polarized signal; and a dual-band orthomode transducer, said transducer receiving the linearly polarized first signal from the polarizing system and directing the linearly polarized second signal to the polarizing system, said transducer separating the first signal into horizontally and vertically polarized components and combining horizontally and vertically polarized components into the second signal.

2. The antenna system according to claim 1 wherein the orthomode transducer has only three signal ports.

3. The antenna system according to claim 1 wherein the first and second signals are at different frequencies and the polarizing system is a dual-band polarizing system.

4. An antenna system comprising:

an antenna element, said antenna element receiving a first signal and transmitting a second signal;

a polarizing system, said polarizing system converting the first signal from a circularly polarized signal to a linearly polarized signal and converting the second signal from a linearly polarized signal to a circularly polarized signal;

a dual-band orthomode transducer, said transducer receiving the linearly polarized first signal from the polarizing system and directing the linearly polarized second signal to the polarizing system, said transducer separating the first signal into horizontally and vertically polarized components and combining horizontally and vertically polarized components into the second signal, said orthomode transducer including a widened cylindrical portion and a narrowed cylindrical portion connected together by a conical portion; and a plurality of waveguides connected to the transducer.

5. An antenna system comprising:

an antenna element, said antenna element receiving a first signal and transmitting a second signal;

a polarizing system, said polarizing system converting the first signal from a circularly polarized signal to a linearly polarized signal and converting the second signal from a linearly polarized signal to a circularly polarized signal;

a dual-band orthomode transducer, said transducer receiving the linearly polarized first signal from the polarizing system and directing the linearly polarized second signal to the polarizing system, said transducer separating the first signal into horizontally and vertically polarized components and combining horizontally and vertically polarized components into the second signal, said orthomode transducer including a widened cylindrical portion and a narrowed cylindrical portion connected together by a conical portion; and a plurality of waveguides connected to the transducer, said plurality of waveguides being rectangular waveguides, where each of a first and second of the waveguides are connected to the conical portion through a narrowed iris, and each of a third and fourth of the waveguides are connected to the narrowed cylindrical portion through a narrowed iris.

6. An antenna system comprising:

an antenna element, said antenna element receiving a first signal and transmitting a second signal;

a polarizing system, said polarizing system converting the first signal from a circularly polarized signal to a linearly polarized signal and converting the second signal from a linearly polarized signal to a circularly polarized signal;

a dual-band orthomode transducer, said transducer receiving the linearly polarized first signal from the polarizing system and directing the linearly polarized second signal to the polarizing system, said transducer separating the first signal into horizontally and vertically polarized components and combining horizontally and vertically polarized components into the second signal; and a cylindrical waveguide and two rectangular waveguides, each rectangular waveguide being connected to the cylindrical waveguide by a stepped transformer.

7. An antenna system comprising:

an antenna element, said antenna element receiving a first signal and transmitting a second signal;

a polarizing system, said polarizing system converting the first signal from a circularly polarized signal to a linearly polarized signal and converting the second signal from a linearly polarized signal to a circularly polarized signal;

a dual-band orthomode transducer, said transducer receiving the linearly polarized first signal from the polarizing system and directing the linearly polarized second signal to the polarizing system, said transducer separating the first signal into horizontally and vertically polarized components and combining horizontally and vertically polarized components into the second signal; and a high pass filter and a low pass filter, said high pass filter filtering the first signal from the transducer and said low pass filter filtering the second signal before it is sent to the transducer.

8. An antenna system on a satellite for receiving satellite uplink signals and transmitting satellite downlink signals, said uplink signal and downlink signal having different frequencies, said system comprising:

a dual frequency feed horn, said feed horn receiving the uplink signal and transmitting the downlink signal;

a dual frequency polarizer, said polarizer converting the uplink signal from a circularly polarized signal to a linearly polarized signal and converting the downlink signal from a linearly polarized signal to a circularly polarized signal; and a dual-band orthomode transducer, said transducer being a waveguide device that receives the linearly polarized uplink signal from the polarizer and directs the linearly polarized downlink signal to the polarizer, wherein the transducer separates the uplink signal into horizontally and vertically polarized components and combines horizontally and vertically polarized components into the downlink signal.

9. The antenna system according to claim 8 wherein the transducer has only three signal ports.

10. An antenna system on a satellite for receiving satellite uplink signals and transmitting satellite downlink signals, said uplink signal and downlink signal having different frequencies, said system comprising:

a dual frequency feed horn, said feed horn receiving the uplink signal and transmitting the downlink signal;

a dual frequency polarizer, said polarizer converting the uplink signal from a circularly polarized signal to a linearly polarized signal and converting the downlink signal from a linearly polarized signal to a circularly polarized signal; and a dual-band orthomode transducer, said transducer being a waveguide device that receives the linearly polarized uplink signal from the polarizer and directs the linearly polarized downlink signal to the polarizer, wherein the transducer separates the uplink signal into horizontally and vertically polarized components and combines horizontally and vertically polarized components into the downlink signal, said orthomode transducer including a widened cylindrical portion and a narrowed cylindrical portion connected together by a conical portion, said orthomode transducer further including a first and second waveguide connected to the conical portion through separate narrowed irises, and a third and fourth waveguide connected to the narrowed cylindrical portion through separate narrowed irises.

11. An antenna system on a satellite for receiving satellite uplink signals and transmitting satellite downlink signals, said uplink signal and downlink signal having different frequencies, said system comprising:

a dual frequency feed horn, said feed horn receiving the uplink signal and transmitting the downlink signal;

a dual frequency polarizer, said polarizer converting the uplink signal from a circularly polarized signal to a linearly polarized signal and converting the downlink signal from a linearly polarized signal to a circularly polarized signal; and a dual-band orthomode transducer, said transducer being a waveguide device that receives the linearly polarized uplink signal from the polarizer and directs the linearly polarized downlink signal to the polarizer, wherein the transducer separates the uplink signal into horizontally and vertically polarized components and combines horizontally and vertically polarized components into the downlink signal, said orthomode transducer including a cylindrical waveguide and two rectangular waveguides, each of the rectangular waveguides being connected to the cylindrical waveguide by a stepped transformer.

12. An antenna system on a satellite for receiving satellite uplink signals and transmitting satellite downlink signals, said uplink signal and downlink signal having different frequencies, said system comprising:

a dual frequency feed horn, said feed horn receiving the uplink signal and transmitting the downlink signal;

a dual frequency polarizer, said polarizer converting the uplink signal from a circularly polarized signal to a linearly polarized signal and converting the downlink signal from a linearly polarized signal to a circularly polarized signal;

a dual-band orthomode transducer, said transducer being a waveguide device that receives the linearly polarized uplink signal from the polarizer and directs the linearly polarized downlink signal to the polarizer, wherein the transducer separates the uplink signal into horizontally and vertically polarized components and combines horizontally and vertically polarized components into the downlink signal; and a high pass filter and a low pass filter, said high pass filter filtering the uplink signal from the transducer and said low pass filter filtering the downlink signal before it is sent to the transducer.

13. A feed network for an antenna system, said network comprising:

a polarizing system, said polarizing system converting a first signal from a circularly polarized signal to a linearly polarized signal and converting a second signal from a linearly polarized signal to a circularly polarized signal; and a dual-band orthomode transducer, said transducer receiving the linearly polarized first signal from the polarizing system and directing the linearly polarized second signal to the polarizing system, said transducer separating the first signal into horizontally and vertically polarized components and combining horizontally and vertically polarized components into the second signal.

14. The feed network according to claim 13 wherein the orthomode transducer includes a widened cylindrical portion and a narrowed cylindrical portion connected together by a conical portion, and wherein the orthomode transducer further includes a first and second waveguide connected to the conical portion through separate narrowed irises, and a third and fourth waveguide connected to a narrowed cylindrical portion through separate narrowed irises.

15. The feed network according to claim 13 wherein the orthomode transducer includes a cylindrical waveguide and two rectangular waveguides, where each of the rectangular waveguides are connected to the cylindrical waveguide by a stepped transformer, and wherein the rectangular waveguides and the cylindrical waveguide provide phase matching for two separate frequency bands.

* * * * *